US008840001B2

(12) United States Patent
Pluska

(10) Patent No.: US 8,840,001 B2
(45) Date of Patent: Sep. 23, 2014

(54) APPARATUS FOR BREAKING OFF THE HEAD OF A GLASS AMPOULE

(76) Inventor: Cezary Pluska, Kiel (DE)

( * ) Notice: Subject to any disclaimer, the term of this patent is extended or adjusted under 35 U.S.C. 154(b) by 314 days.

(21) Appl. No.: 13/203,054

(22) PCT Filed: Feb. 27, 2010

(86) PCT No.: PCT/DE2010/000224

§ 371 (c)(1),
(2), (4) Date: Aug. 24, 2011

(87) PCT Pub. No.: WO2010/099785

PCT Pub. Date: Sep. 10, 2010

(65) Prior Publication Data

US 2011/0303716 A1 Dec. 15, 2011

(30) Foreign Application Priority Data

Mar. 3, 2009 (DE) ..... 20 2009 003 024 U
May 19, 2009 (DE) ..... 20 2009 007 161 U

(51) Int. Cl.
*B26F 3/02* (2006.01)
*B67B 7/92* (2006.01)

(52) U.S. Cl.
CPC ..... *B67B 7/92* (2013.01)
USPC ..... 225/93; 225/96.5

(58) Field of Classification Search
USPC ..... 225/93, 96.5, 103, 104
See application file for complete search history.

(56) References Cited

U.S. PATENT DOCUMENTS

| | | | | | |
|---|---|---|---|---|---|
| 3,450,319 | A * | 6/1969 | Campbell, Jr. et al. | ..... | 225/104 |
| 3,749,271 | A * | 7/1973 | Ellis et al. | ..... | 215/47 |
| 4,241,627 | A * | 12/1980 | Snow | ..... | 81/3.55 |
| 5,129,566 | A * | 7/1992 | Ogden et al. | ..... | 225/93 |
| 6,099,510 | A * | 8/2000 | Ruther et al. | ..... | 604/181 |
| 2009/0277941 | A1 * | 11/2009 | Riverstone | ..... | 225/1 |

FOREIGN PATENT DOCUMENTS

| | | | |
|---|---|---|---|
| DE | 1183634 | B | 12/1964 |
| FR | 2209291 | A5 | 6/1974 |
| GB | 2081692 | A * | 2/1982 |

* cited by examiner

*Primary Examiner* — Kenneth E. Peterson
*Assistant Examiner* — Jennifer Swinney
(74) *Attorney, Agent, or Firm* — David A. Guerra

(57) ABSTRACT

An apparatus for breaking off the head of a glass ampoule that is composed of a cylindrical body, a neck forming a predetermined breaking point and a head, comprising an incline extending in an inclined manner to the axis of the ampoule to be inserted toward the same, a first support surface is disposed on the side of the incline causing a break-off of the head in the region above the bottom of the ampoule to be inserted at a radius of the ampoule from the axis of the apparatus and a second support surface is disposed on the opposite side beneath the neck of the ampoule at a distance from the axis of the apparatus that corresponds to the radius of the ampoule, during a relative movement of the apparatus to the ampoule in the direction of the axis thereof the incline breaks off the head at the neck.

8 Claims, 1 Drawing Sheet

APPARATUS FOR BREAKING OFF THE HEAD OF A GLASS AMPOULE

CROSS-REFERENCE TO RELATED APPLICATIONS

This application is an U.S. national phase application under 35 U.S.C. §371 based upon co-pending International Application No. PCT/DE2010/000224 filed on Feb. 27, 2010. Additionally, this U.S. national phase application claims the benefit of priority of co-pending International Application No. PCT/DE2010/000224 filed on Feb. 27, 2010, German Application No. 20 2009 003 024.5 filed Mar. 3, 2009, and German Application No. 20 2009 007 161.8 filed on May 19, 2009. The entire disclosures of the prior applications are incorporated herein by reference. The international application was published on Sep. 10, 2010 under Publication No. WO 2010/099785 A1.

BACKGROUND OF THE INVENTION

1. Field of the Invention

The invention relates to an apparatus for breaking off the head of a glass ampoule that is composed of a cylindrical body, a neck forming a predetermined breaking point and a head, comprising an ampoule holder and an incline extending in an inclined manner to the axis of the ampoule.

2. Description of the Prior Art

An apparatus of this type is known from EP 0 926 900 B1. In this known apparatus the incline forms a separate body that can be moved relative to the ampoule. This apparatus is quite complex.

SUMMARY OF THE INVENTION

The invention is therefore based on the object of producing an apparatus for breaking off the head of an ampoule that has a very simple design and can therefore be produced cost-effectively.

According to the invention this object is achieved by a first support surface (C) disposed on the side of the incline (A) causing a break-off of the head in the region above the bottom of the ampoule to be inserted at a radius of the ampoule from the axis of the apparatus and a second support surface (B) is disposed on the opposite side beneath the neck of the ampoule (inserted in the apparatus) at a distance from the axis of the apparatus that corresponds to the radius of the ampoule, wherein during a relative movement of the apparatus to the ampoule in the direction of the axis thereof the incline (A) breaks off the head at the neck.

A preferred exemplary embodiment is characterized by a spring element that is arranged in the area of the incline opposite thereto and at a distance therefrom that is smaller than the outside diameter of the head, prior to insertion of the ampoule, and that holds the broken-off head until the tip thereof is acted on manually.

BRIEF DESCRIPTION OF THE DRAWINGS

The invention is explained using a drawing.

DETAILED DESCRIPTION OF THE INIVENTION

In all its exemplary embodiments, the apparatus has an incline A that projects in an inclined manner relative to the axis of the ampoule inserted into the apparatus. Here the incline A forms a support surface that breaks off the head of the ampoule at its neck in the case of a relative movement of the apparatus in the direction of the axis of the ampoule. To absorb the forces occurring in the process the apparatus has a first support surface C that is arranged on the same side of the longitudinal axis of the apparatus as the incline A bordering on the bottom of the ampoule (inserted into the apparatus from below), and a second support surface B disposed on the opposite side below the neck of the ampoule inserted into the apparatus. When the apparatus is pushed onto the ampoule (or when the ampoule is pushed into the apparatus) the head of the ampoule is broken off by the incline A at the head that forms a predetermined breaking point. The inside distance of the support surfaces B and C from each other here corresponds to the thickness of the ampoule that is to be received, it can be pushed into the apparatus in the direction of the axis thereof such that its axis corresponds to the axis of the apparatus.

Figure 1:
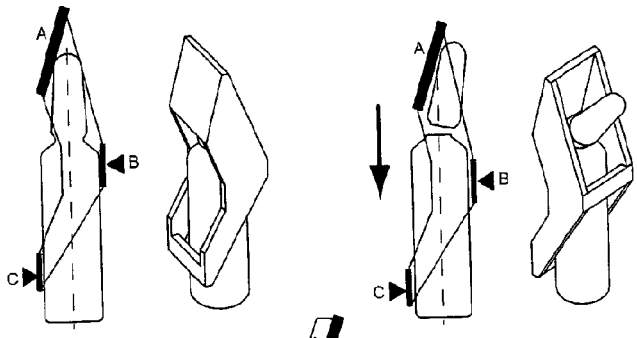
FIG. 1 shows a first exemplary embodiment of the invention.
Figure 2:
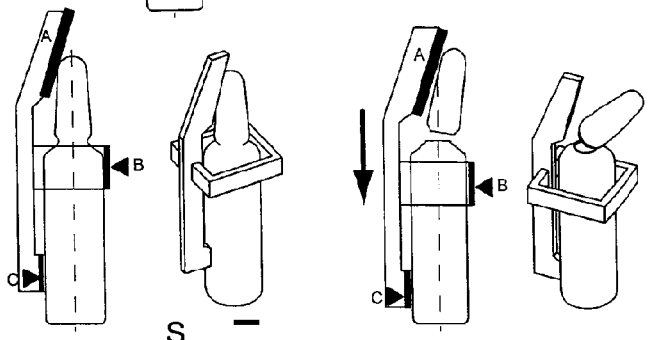
FIG. 2 shows a second exemplary embodiment of the invention.

In the exemplary embodiment shown in FIG. 1 the apparatus is designed like a rocker, in the exemplary embodiment shown in FIG. 2 the incline A and the support surface C are elements of a strip against which a frame is placed that grips around the ampoule on being pushed into the apparatus.

Figure 3:
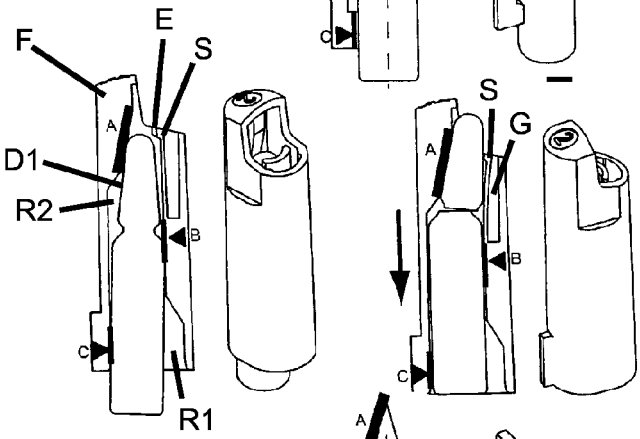
FIG. 3 shows a third exemplary embodiment of the invention.

In the exemplary embodiment according to FIG. 3 the apparatus is provided with a spring element S that is disposed opposite the incline A, the distance of the spring element S from the incline A being smaller than the outside diameter D1 of the head. The spring element S will firmly hold the head after being broken off until its tip is acted on manually and the head is released.

The spring element S extends from an area adjacent the second support surface B in a direction substantially parallel with the axis of the apparatus. The spring element S is configured to flex away from the incline A when the tip of the head of the ampoule is received through a second opened end of the frame F. The frame F includes a gap G defined between the spring element S and the frame F, and the gap G is configured to receive a free end of the spring element S when flexed by the head of the ampoule. The free end of the spring element S includes an extension E extending away from the free end toward the incline A. The extension E is configured to contact the head of the ampoule when the tip of the head of the ampoule is received through the second opened end. The frame F has a first recess R1 defined adjacent to and in communication with the first opened end, and a second recess R2 defined between the incline A and the first support surface C. The second recess R2 is located on the side of the incline A and the first support surface C.

Figure 4:
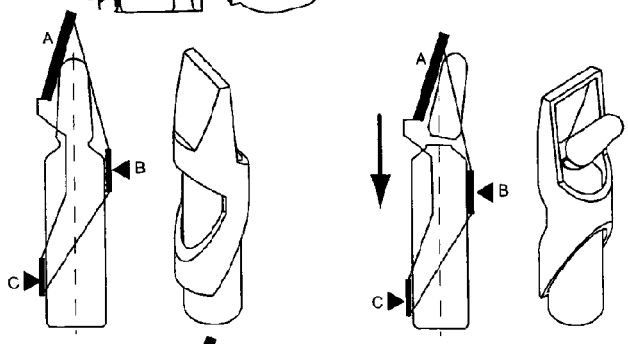
FIG. 4 shows a fourth exemplary embodiment of the invention.

In the exemplary embodiment according to FIG. 4 the apparatus is of an essentially cylindrical design (that is except the incline A).

Figure 5:
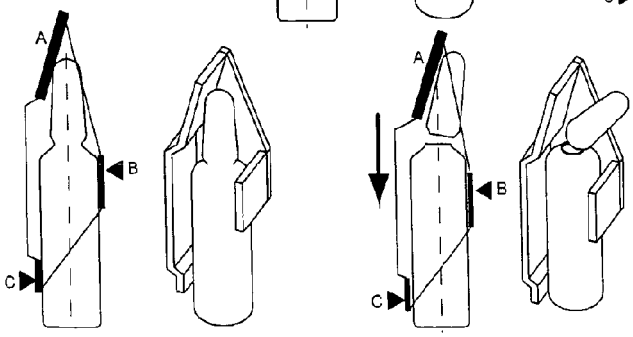
FIG. 5 shows a fifth exemplary embodiment of the invention, the figures each representing a schematic diagram and a perspective view of the ampoule before the head is broken off (1st figure) and after the head has been broken off ($2^{nd}$ figure).

In the exemplary embodiment according to FIG. 5 the apparatus with an essentially stretched element forming the incline A and the support surface C is shaped a side surface that forms the support surface B on its free side.

The invention claimed is:

1. An apparatus for breaking off the head of a glass ampoule that is composed of a cylindrical body, a neck forming a predetermined breaking point and a head, said apparatus comprising:

a frame having a first opened end configured to receive the ampule therethrough, and a second opened end configured to define access to a tip of the head of the ampoule;

an incline associated with the second opened end and extending in an inclined manner to an axis of the ampoule to be inserted toward the same;

a first support surface disposed on a side of the incline causing a break-off of the head in a region above a bottom of the ampoule to be inserted at a radius of the ampoule from an axis of the apparatus;

a second support surface disposed on an opposite side of the incline and beneath the neck of the ampoule when inserted in the apparatus at a distance from the axis of the apparatus that corresponds to the radius of the ampoule; and a spring element that is arranged in an area of the incline opposite thereto and at a distance therefrom that is smaller than an outside diameter of the head prior to the insertion of the ampoule, the spring is configured to hold the broken-off head against the incline until the tip thereof is acted on manually;

wherein during a relative movement of the apparatus to the ampoule in the direction of the axis thereof the incline contacts and breaks off the head at the neck.

2. The apparatus according to claim 1, wherein the spring element extends from an area adjacent the second support surface in a direction substantially parallel with the axis of the apparatus.

3. The apparatus according to claim 1, wherein the spring element has a free end spaced apart from the incline a distance smaller than the outside diameter of the head prior to insertion of the ampoule.

4. The apparatus according to claim 3, wherein the spring element is configured to flex away from the incline when the tip of the head of the ampoule is received through the second opened end.

5. The apparatus according to claim 3, wherein the frame further comprises a gap defined between the spring element and the frame, the gap is configured to receive the free end of the spring element when flexed by the head of the ampoule.

6. The apparatus according to claim 3, wherein the free end of the spring element further comprises an extension extending away from the free end toward the incline, the extension is configured to contact the head of the ampoule when the tip of the head of the ampoule is received through the second opened end.

7. The apparatus according to claim 1, wherein the frame has a first recess defined adjacent to and in communication with the first opened end.

8. The apparatus according to claim 1, wherein the frame has a second recess defined between the incline and the first support surface, and on the side of the incline and the first support surface.

* * * * *